US009279432B2

(12) United States Patent
Jirgal et al.

(10) Patent No.: US 9,279,432 B2
(45) Date of Patent: Mar. 8, 2016

(54) MEDIA SEPARATING DEVICE, IN PARTICULAR HYDRAULIC ACCUMULATOR, INCLUDING ASSOCIATED MEASURING APPARATUS AND MEASURING METHOD

(75) Inventors: Matthias Leo Jirgal, Saarbrücken (DE); Horst Mannebach, Münstermalfeld (DE); Martin Groben, Sulzbach (DE)

(73) Assignee: HYDAC TECHNOLOGY GMBH, Sulzbach/Saar (DE)

( * ) Notice: Subject to any disclaimer, the term of this patent is extended or adjusted under 35 U.S.C. 154(b) by 95 days.

(21) Appl. No.: 13/261,771

(22) PCT Filed: Apr. 7, 2012

(86) PCT No.: PCT/EP2012/001559
§ 371 (c)(1),
(2), (4) Date: Nov. 4, 2013

(87) PCT Pub. No.: WO2012/149994
PCT Pub. Date: Nov. 8, 2012

(65) Prior Publication Data

US 2014/0060688 A1 Mar. 6, 2014

(30) Foreign Application Priority Data

May 5, 2011 (DE) ..... 10 2011 100 532

(51) Int. Cl.
*F15B 1/16* (2006.01)

(52) U.S. Cl.
CPC ..... *F15B 1/165* (2013.01); *F15B 2201/205* (2013.01); *F15B 2201/3152* (2013.01); *F15B 2201/50* (2013.01)

(58) Field of Classification Search
CPC ..... F15B 2201/205
USPC ..... 73/37
See application file for complete search history.

(56) References Cited

U.S. PATENT DOCUMENTS

| | | | | | |
|---|---|---|---|---|---|
| 3,920,047 | A * | 11/1975 | Mercier | F15B 1/165 | 138/30 |
| 4,428,401 | A * | 1/1984 | Chun | F15B 1/08 | 138/30 |
| 4,788,851 | A * | 12/1988 | Brault | 73/49.2 | |
| 4,907,621 | A * | 3/1990 | Sugimura | F15B 1/08 | 138/104 |
| 6,871,671 | B2 * | 3/2005 | Weber | F15B 1/14 | 138/26 |

FOREIGN PATENT DOCUMENTS

| | | |
|---|---|---|
| DE | 29 12 618 A1 | 10/1979 |
| DE | 33 28 750 A1 | 2/1984 |
| DE | 40 06 905 A1 | 9/1991 |
| DE | 41 15 342 A1 | 11/1992 |

(Continued)

*Primary Examiner* — Hezron E Williams
*Assistant Examiner* — Mark A Shabman
(74) *Attorney, Agent, or Firm* — Wenderoth, Lind & Ponack, L.L.P.

(57) ABSTRACT

A media separating device (1), in particular a hydraulic accumulator (3), has a movable separator (5) separating two media (7, 9) received in media chambers (11, 13) and differing from each other. A measuring apparatus (15, 115) can detect an overflow of at least one medium (7, 9) from a medium chamber (11, 13) via the separator (5) into the other medium chamber (11, 13) having the other medium (9, 7).

23 Claims, 3 Drawing Sheets

(56) References Cited

FOREIGN PATENT DOCUMENTS

| | | | |
|---|---|---|---|
| DE | 43 33 098 | A1 | 1/1995 |
| DE | 196 51 384 | A1 | 6/1998 |
| DE | 101 31 855 | A1 | 1/2003 |
| DE | 101 33 745 | A1 | 1/2003 |
| DE | 101 52 777 | A1 | 5/2003 |
| DE | 10 2005 001 097 | A1 | 7/2006 |
| DE | 10 2006 004 120 | A1 | 7/2007 |
| DE | 10 2006 040 325 | A1 | 3/2008 |
| DE | 10 2009 010 775 | A1 | 9/2010 |

* cited by examiner

MEDIA SEPARATING DEVICE, IN PARTICULAR HYDRAULIC ACCUMULATOR, INCLUDING ASSOCIATED MEASURING APPARATUS AND MEASURING METHOD

FIELD OF THE INVENTION

The invention relates to a media separating device, in particular a hydraulic accumulator having a movable separating means or separator for separating two different media accommodated in media chambers. The invention also relates to a measuring apparatus, designed as a retrofitting or conversion kit as well as a measuring method for operating the measuring apparatus in the media separating device.

BACKGROUND OF THE INVENTION

Media, in particular flowable media as defined in the present application, are often used in drive technology, for example, as lubricants and/or coolants or as pressure means in hydraulic installations for transmitting energies from a pressure medium source to a consumer. Flowable media, for example, hydraulic oil or other pressurized fluids are in media separating means, such as hydraulic accumulators, which fulfill a wide variety of functions in hydraulic installations and serve, for example, to store energy, to supply a fluid reserve for emergency actuation of power consuming devices, and to provide pressure surge attenuation and the like. Secure and proper operation of a hydraulic installation requires not only knowledge of physical operating parameters such as pressure or flow velocities, but also information about whether the media separating means itself is trouble-free and functions reliably in operation.

DE 101 52 777 A1 describes a device for determining the quality of a medium, in particular a lubricant and/or coolant, having multiple sensors that deliver an electric output signal as a function of the respective sensor-specific input variable. One sensor is a temperature sensor that delivers an output signal basically dependent only on the temperature of the medium and basically independent of the quality of the medium in particular. Another sensor delivers an output signal that depends on the quality of the medium, as well as the temperature of the medium. The sensors used are arranged on a shared substrate, which substrate can be immersed in the respective medium to be tested. The device designed in this way permits determination of quality-determining parameters of flowable media, independently of their prevailing temperature.

DE 10 2009 010 775 A1 describes a media separating means in the form of a hydraulic accumulator for receiving at least a partial volume of a liquid under pressure. The hydraulic accumulator has a housing with at least one connection point for connecting the hydraulic accumulator to a hydraulic device such as a hydraulic circuit. A data memory is a component of the hydraulic accumulator. The data stored in the data memory can be electronically read out by a read and/or write device situated outside of the hydraulic accumulator. The operating state of the hydraulic accumulator can therefore be determined and monitored reliably. The monitoring can also be automated and controlled by a control unit.

With the known approach, an elastomer diaphragm, designed as a bladder, separates two media chambers from one another inside the accumulator housing. One media chamber preferably has a compressible working gas, such as nitrogen gas, as the medium. The other media chamber is fillable with hydraulic fluid as another pressurized medium, coming from the hydraulic device, through the connection point in the accumulator housing. The filling is accomplished against the compressive force of the working gas, such that the elastomeric separating means "contracts" and moves to this extent. If hydraulic fluid is needed again on the part of the hydraulic device, the separating means "relaxes," and the required amount of fluid is discharged from the accumulator housing through the connection, under the influence of the compressive force of the working gas. A partial amount of fluid usually remains in the accumulator. Due to the permeability of the diaphragm material, an unwanted transfer of the hydraulic fluid to the gas side of the hydraulic accumulator occurs in the long term, which transfer may occur suddenly due to the development of cracks or tears, for example, in the event of failure of the separation diaphragm. The result is that the "working capacity" of the hydraulic accumulator is impaired, or it may even fail completely within the hydraulic circuit, making operation of a hydraulic installation substantially more difficult or even impossible.

DE 40 06 905 A1 has already proposed creating a method and a device that can be used for this method for measuring the pressure of a gas, in particular for determining the gas charge pressure in a hydraulic accumulator and/or for maintaining a preselected pressure setpoint value in the container. An unwanted transfer of hydraulic fluid to the working gas side of the accumulator could be detectable by this system. This approach is relatively complex and is expensive to implement with regard to the multitude of components. Thus, for a corresponding measuring method, a connection that can be used at least temporarily to exchange working gas between the hydraulic accumulator, and a measuring chamber is to be established at least temporarily for a corresponding measuring method. This connection preferably has only a fraction of the container volume and has a pressure measuring apparatus. In addition, the connection between the hydraulic accumulator and a refilling device is also established at least temporarily for maintaining the pressure setpoint value. This refilling device refills the container with gas on the working gas side when the actual pressure value in the container is lower than the setpoint pressure value.

SUMMARY OF THE INVENTION

An object of the present invention is to create an improved media separating device, in particular in the form of a hydraulic accumulator, which is capable of detecting the interference cases described above using few components, being inexpensively and promptly forwarding the results to the operator of the hydraulic installation to which such hydraulic accumulators are regularly connected.

These objects are basically achieved according to the invention by the media separating device and by a measuring apparatus, as well as by a measuring method for operating the measuring apparatus, where an overflow of at least one medium of a media chamber of the media separating system by can be detected by a measuring apparatus in the other media chamber with the other medium. With the help of the measuring apparatus, preferably at least the presence and optionally the type of a flowable medium can be detected easily, preferably in any design of a media separating device, as soon as at least one of the two media is inadvertently transferred from its originating media chamber to the other media chamber. The detection of media incapable of flow may serve here in particular as a prerequisite for the use of safety functions or the functionally reliable control of operating sequences, even in hydraulic installations having a complex design.

In a particularly preferred exemplary embodiment of the media separating device, the measuring apparatus has at least one sensor element, which sensor element can ascertain the overflow of media over the separator using a thermal and/or chemical and/or physical and/or optical and/or acoustic and/or electric measuring method. The respective sensor element advantageously has a connection to a fixed location in relation to at least one of the media chambers, such that, in any assumed position of the separator, the sensor element can be brought into contact with the medium that has overflowed. The connection is accomplished in a particularly advantageous exemplary embodiment of the media separating device by at least one flexible cable connection, whereby the cable is connected to the sensor element at its one end and is connected to the anchoring point using parts of an accumulator housing at its other end. The accumulator housing borders the media chambers at least partially.

The end of the cable connection adjacent to the fixed location is connected to a plug part that preferably also comprises an electronic analyzer. A media separating device having a measuring apparatus for detection of an overflow of at least one medium of a media chamber through the separator into the other media chamber with the other medium is created in a particularly compact design that is inexpensive to manufacture.

The media separating device is designed as a hydraulic accumulator in the manner of a bladder accumulator, in a preferred exemplary embodiment, having a flexible bladder as the separator. The respective sensor element is arranged on the media chamber designed as the gas side within the accumulator housing of the hydraulic accumulator. The additional media chamber of the hydraulic accumulator forms the fluid side. Other designs of media separating device in particular in the form of hydraulic accumulators such as bellows accumulators, diaphragm accumulators or piston accumulators can fundamentally be equipped with the inventive measuring apparatus in this regard.

Advantageously, the measuring apparatus, a retrofitting or conversion kit, can be used subsequently in existing media separating device and to put it to use. The measuring apparatus designed as a retrofitting or conversion kit has at least one sensor element and a cable connection, as well as an electronic analyzer and preferably a separator. For example, if the operator of a hydraulic installation wants to improve the monitoring of the media separating device in the hydraulic installation in particular, then the existing media separating device can be modified and improved by the subsequent installation of a retrofitting or conversion kit in that regard.

A measuring method for operation of the measuring apparatus in a media separating device may advantageously be designed as a thermal measuring method. The thermal conductivity of a medium in a media chamber of the media separating system is used for analysis. The heating power required for a defined increase in the temperature of the medium is determined by a sensor element provided with at least one heating resistor. The temperature increase in the medium in the media chamber when using a defined heating power can also be determined. The use of a transient heating wire method in which a heating wire in the sensor element serves both as a heat source and as a temperature sensor is preferably suitable for this purpose. Instead of using a wire, a thin film resistor on a ceramic substrate may also be used. The thin film resistor is advantageously connected as a branch of a Wheatstone bridge. A power supply voltage to the Wheatstone bridge can be pulsed and the rise in the bridge signal, i.e., the increase in temperature, can be analyzed by the analysis unit.

Advantageously the measuring method can be an optical measuring method that determines the luminescence of the medium in the respective media chamber. An optical measuring method may also be used to advantage, wherein the attenuation and reflection properties of the respective overflow medium are used optically for the analysis.

The electric conductivity is preferably suitable as the electric measuring method in the event of inadvertent overflow of one medium into the other medium. This measuring method is suitable in particular when the media used in the media separating device do not form insulators. The dielectric properties of the respective medium can be used advantageously for analysis. Furthermore, a chemical measuring method can be used advantageously, in particular measuring methods in which at least a portion of the sensor element changes based on a chemical or physical reaction upon coming in contact with the respective other medium. Such changes may include a detectable swelling or even dissolution of part of the sensor element. Color changes based on chemical reaction of the medium with a part of the sensor element may also be utilized to detect the overflow of one medium of a media chamber through the separator into the other media chamber containing the other medium.

Other objects, advantages and salient features of the present invention will become apparent from the following detailed description, which, taken in conjunction with the drawings, discloses preferred embodiments of the present invention.

BRIEF DESCRIPTION OF THE DRAWINGS

Referring to the drawings that form a part of this disclosure and that are diagrammatic and not drawn to scale.

DETAILED DESCRIPTION OF THE INVENTION

Figure 1:
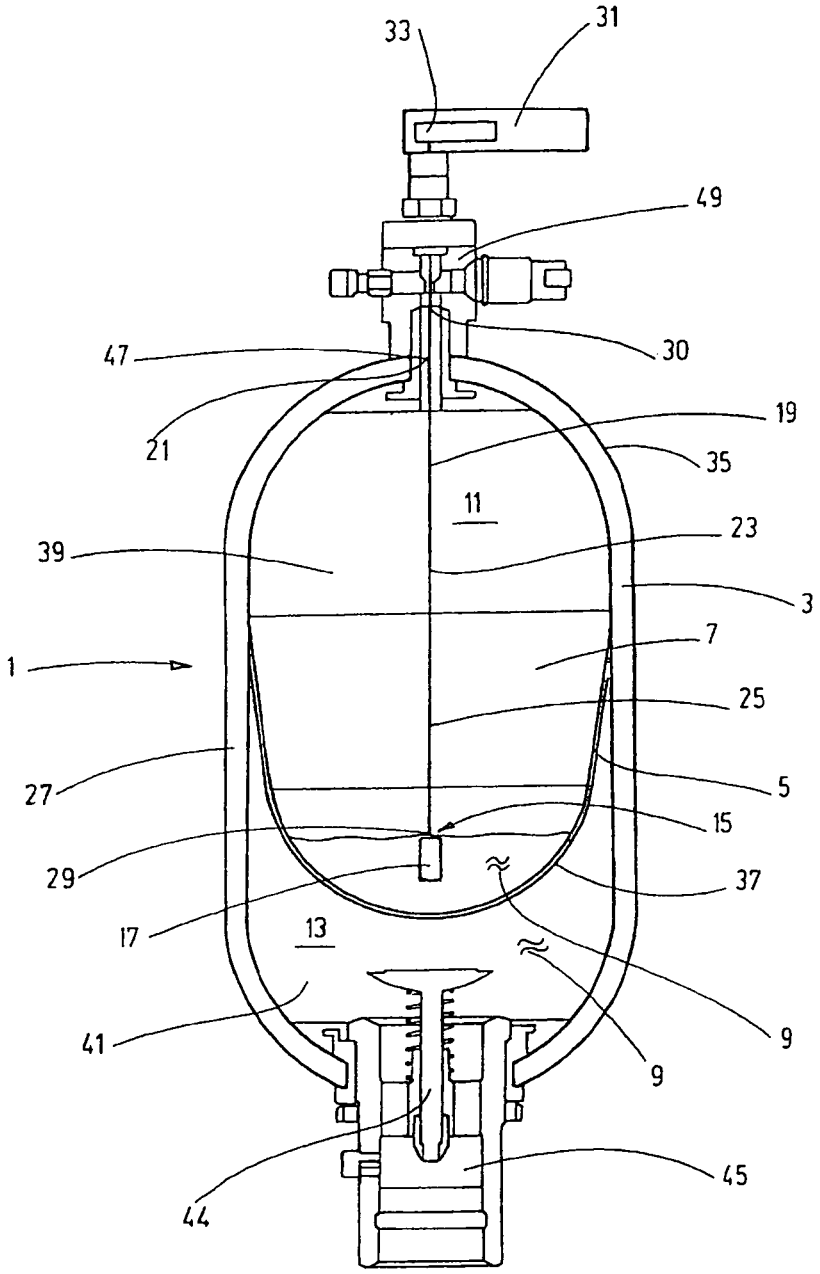
FIG. 1 is a side view in section a media separating device in the form of a hydraulic accumulator designed as a bladder accumulator according to an exemplary embodiment of the invention.

FIG. 1 shows a media separating device or system 1 in the form of a hydraulic accumulator 3 having a movable separator 5 for separating two media 7, 9. The media 7, 9 are accommodated in different media chambers 11, 13, with the movable separator 5 separating the media chambers 11, 13 from one another in a medium-tight manner. A measuring apparatus 15 on the whole serves to detect an accidental overflow of the medium 9 out of the media chamber 13 through the separator 5 into the other media chamber 11 containing the other medium 7.

The hydraulic accumulator 3 is designed in the manner of a bladder accumulator 35 and has a flexible bladder 37 of an elastomer material as the separator 5. The hydraulic accumulator 3 receives a gaseous medium 7 in the form of a working gas, in particular in the form of nitrogen gas, and to receive an additional fluid medium 9 of hydraulic fluid in the present case. The media 7, 9 in this regard may readily be under a pressure of up to 600 bar or more. In the exemplary embodiment shown in FIG. 1, a sensor element 17 is arranged in the media chamber 11 designed as the gas side 39 inside an accumulator housing 27 of the hydroaccumulator 3. The additional media chamber 13 inside the accumulator housing 27 forms the fluid side 41 of the hydraulic accumulator 3. A plate valve 44 is inserted into the fluid connecting opening 45 of the hydraulic accumulator 3 in the usual design and serves to trigger the media flow on the fluid side 41 of the hydraulic accumulator 3. The hydraulic accumulator 3 can be connected in a fluid-carrying connection to additional hydraulic equipment (not shown) in the form of a hydraulic circuit or the like, for example, by the fluid connection opening 45.

On the opposite side from the connection opening 45 and as viewed in FIG. 1 above the accumulator housing 27, another connection opening 47 is part of a screw-on component 49 by which the hydraulic accumulator 3 can be filled or refilled regularly with working gas on its gas side 39. The design of hydraulic accumulators 3 is as usual and was already described in greater detail in a previous patent application (DE 10 2006 004 120 A1) by the present applicant and is also freely available on the market in a variety of embodiments so that the details need not be described further here.

Instead of the working gas on the gas side 39, a compressible foam or compressible filling bodies, such as hollow foam bodies (not shown) and the like may be used additionally or alternatively as the medium in the media chamber 11. To this extent, the medium 7 introduced then into the media chamber 11 is formed by the materials in this regard. Furthermore, FIG. 1 already illustrates the situation of a bladder rupture, in which fluid 9 from the media chamber side 13 has been mixed unintentionally with the working gas 7 on the gas media chamber side 11. The fluid 9 already collected on the bottom of the elastomer bladder then can be detected via the measuring apparatus 15 with the sensor element 17 described in greater detail below. In particular the measuring apparatus 15 with the sensor element 17 serves to ascertain the accidental overflow of media as described above using a thermal and/or chemical and/or physical and/or optical and/or acoustic and/or electric measuring method.

The respective sensor element 17 has a connection 19 to the accumulator housing 27 via a fixed location 21 in relation to the media chamber 11. In each assumed position of the separating means 5, the sensor element 17 can then be brought into contact with the overflowing medium 9. In the exemplary embodiment shown in FIG. 1, the connection 19 has at least one flexible cable connection 23. The respective cable 25 is connected at its one end 29 to the respective sensor element 17 in an electrically conducting manner and at its other end 30 is connected to parts of an electronic analyzer 33 by the fixed location 21 on the accumulator housing 27. The end 30 of the cable connection 23 adjacent to the fixed location 21 is connected to a plug part 31 in which the electronic analyzer 33 is integrated for analysis of measured signals of the sensor element 17.

Figure 2:
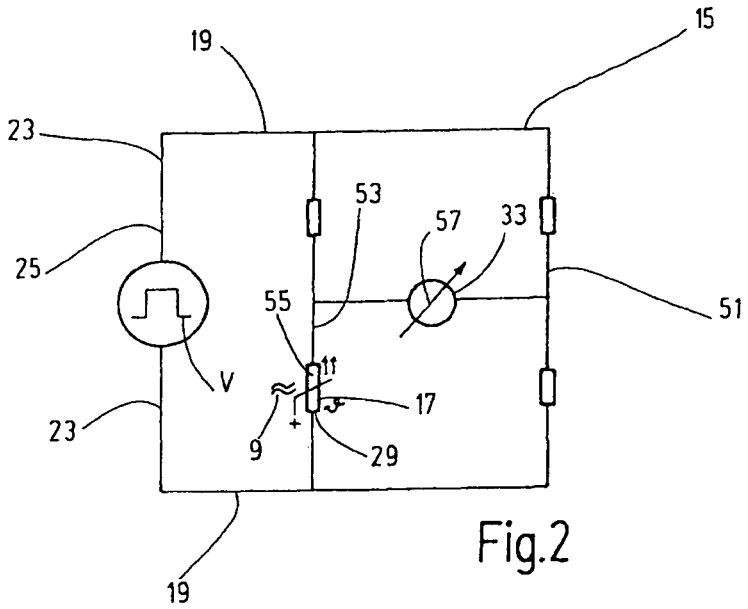
FIG. 2 is a schematic diagram of a thermal measuring method for operation of a measuring apparatus in a media separating device.

The measuring apparatus 15, essential components of which are shown in one exemplary embodiment in FIG. 2, is designed as a retrofitting or conversion kit. The measuring apparatus 15 has at least the sensor element 17, the cable connection 23, the electronic analyzer 33 and preferably the separator 5 for use in a media separating device 1. Hydraulic accumulators that have already been supplied can be retrofitted or converted with the measuring apparatus 15, plus the electronic analyzer 33, using the retrofitting or conversion kit described here by simply exchanging the flexible accumulator bladder with a new accumulator bladder 37 into which the electronic analyzer and measuring units have been integrated. The accumulator bladder may optionally also remain in the hydraulic accumulator 3. To that extent, only the electronic analyzer and measuring unit need be introduced additionally into the hydraulic accumulator 3.

In addition to the hydraulic bladder accumulator 3, other media separating devices may also be equipped with the measuring apparatus 15. Thus, the invention can also be used with piston accumulators in which the separator 5 is formed by a piston that is sealed with respect to the wall of the accumulator housing. By the sealing system, fluid can move inadvertently from the fluid side to the gas side of the accumulator, which is also true in the event a gasket on the piston fails completely. In particular with an embodiment in that regard, it must be ensured at any rate that the respective sensor element 17 can always detect the accidental overflow at the lowest position of the piston by an electric connecting cable 25 selected to be long enough, and can detect this in each position of the piston. The same considerations naturally also apply to the bladder accumulator mentioned above, as well as applying to additional accumulator approaches, such as, for example, bellows accumulators, spring accumulators or diaphragm accumulators, in which the inventive approach may also be used to detect the accidental overflow of media.

The electronic analyzer 33 may also have an output unit based on an electric, optical, acoustic or haptic function and be situated directly on the hydraulic accumulator 3 within a type of plug part 31 in the proposed approach according to FIG. 1. However, by a corresponding cable connection or some other information connection, the electronic analyzer may also be arranged in a central location, for example, inside an overall control unit, which is then capable of monitoring multiple hydraulic accumulators within an overall hydraulic installation for the inadvertent overflow of media to display the failure event for the operator of the installation.

FIG. 2 shows, only as an example, a device for performing a thermal measuring method performed by the measuring apparatus 15 designed for this purpose. The measuring apparatus 15 shown here is capable of detecting the change in the thermal conductivity of the medium 7 on the gas side 39, in particular on admission of the medium 9. To do so the measuring apparatus 15 has a resistance measuring bridge 51 formed in the manner of a Wheatstone bridge. The sensor element 17 designed as a heat resistor 55 is arranged in a bridge branch 53. The resistance measuring bridge 51 is supplied with a pulsed operating voltage V. At the time of activation of the power supply voltage, the resistance measuring bridge 51 is compensated. The differential voltage of the center of the bridge displayed in the display instrument 57 shown here is "0." Due to the operating current in the heating resistor 55, its electric resistance changes so that the resistance measuring bridge 51 is "adjusted." The resulting differential voltage corresponds to the change in the electric resistance of the heating resistor 55 and in turn the increase in temperature. The increase in temperature is characteristic of the presence of a medium to be detected, namely the medium 9 here, which has overflowed inadvertently from the media chamber 13 into the media chamber 11 due to failure of the elastomer accumulator bladder 37.

Figure 3:
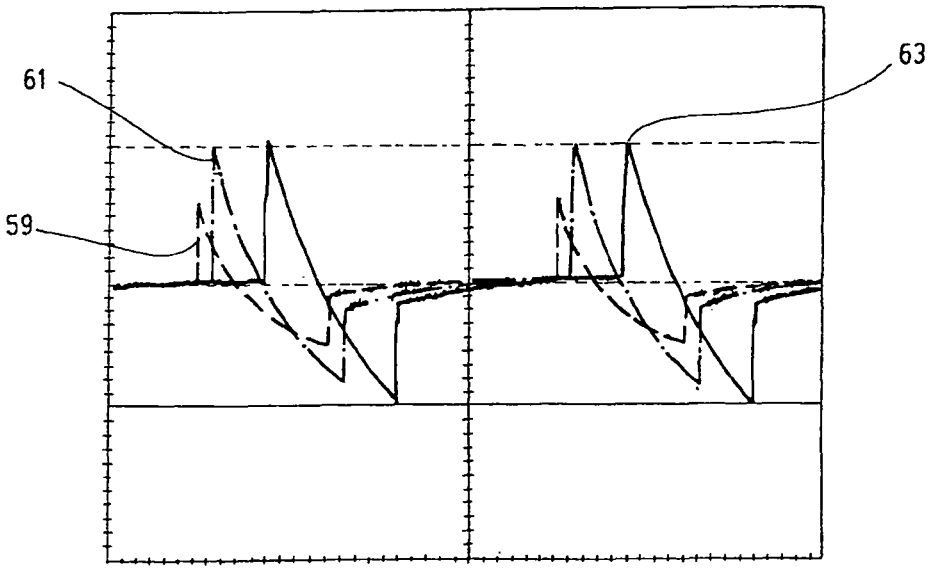
FIG. 3 is a graph of measurement results of a thermal conductivity measurement on admission of a gaseous medium and a liquid medium to a sensor element of the measuring apparatus.

The result of this measuring method is shown in FIG. 3 on the basis of the curve of three measured values 59, 61, 63. These measured value curves show different temperature curves plotted as a function of time on the heating resistor 55. The curve of the measured value 59 with the smaller absolute temperature increases shows a measuring curve for oil as an example. The curve of the measured values 61 and 63 shows temperature increases in a working gas under a pressure of approx. 100 bar (measured curve 61) and at an ambient pressure (measured curve 63). As directly apparent from this figure, significant differences in the temperature curve can be represented as a function of an aggregate state in particular (gaseous or liquid) of a respective medium. Again the presence and type of the respective medium around the sensor element 17 can be deduced on the basis of the curve of the measured values. A threshold value, which allows a differentiation of the media 7, 9 under all operating conditions of the media separating means 1, is determined here on the basis of experiments so that the inadvertent overflow of media can be detected in this way.

Figure 4:
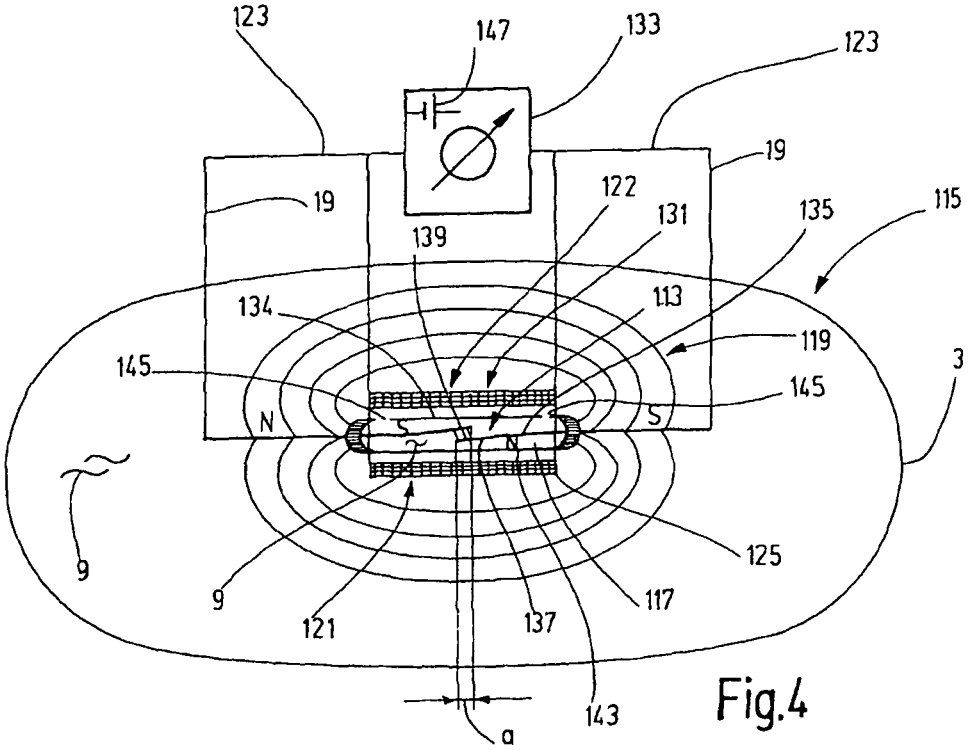
FIG. 4 is a basic diagram of an acoustic measuring method for operation of a measuring apparatus in a media separating system.

FIG. 4 shows a type of acoustic measuring method in greater detail in a schematic diagram based on the use of a measuring apparatus 115. The sensor element 117 has an oscillating device 113, which device is excited to oscillation under the influence of a field 119 of a field generating device 121 (cf. FIG. 5). The oscillating behavior of the oscillating device 113 changes on admission of the flowable medium 9 so that the change in the oscillating behavior of the oscillating device 113 is detected by the measuring apparatus 115. In the exemplary embodiment of the measuring apparatus 115 shown in FIG. 4, the field generating device 121 is formed by a magnetic device 122. The measuring apparatus 115 also has an electromagnetic coil 125 so that the flux of the electromagnetic coil 125 and an electric voltage in the coil 125 are influenced by oscillations of the sensor element 117 excited by the electromagnetic coil 125.

As shown in FIG. 4, the field generating device 121 is combined in a single component, namely here in the form of the electromagnetic coil 125 in a particularly preferred exemplary embodiment of the measuring apparatus 115. The sensor element 117 is connected to the electronic analyzer 133, in the same way as shown in FIG. 1, by a flexible cable connection 123 as the connection 19.

The oscillating device 113 is designed in the manner of a Reed switch 131. The Reed switch 131 has two soft magnetic flexible metal tongues 134, 135 that are opposite one another in the sensor element 117. The tongue ends 137, 139 overlap axially with a length a. The ends 137, 139 of the metal tongues 134, 135 do not contact one another in the exemplary embodiment shown in FIG. 4. Radially the metal tongues 134, 135 are surrounded essentially over their entire length by the magnetic device 122 formed as an electromagnetic coil 125.

When the electromagnetic coil 125 is energized, it generates the magnetic field 119, which is represented only schematically in FIG. 4. The metal tongues 134, 135 move toward one another with an increase in field strength. The metal tongues 134, 135 may also touch one another depending on the field strength of the magnetic field 119. With a decline in the field strength of the magnetic device 122, the metal tongues 134, 135 become released from one another and execute free oscillations. Energization of the electromagnetic coil 125 may also be entirely interrupted to initiate the oscillation process of the metal tongues 134, 135 in this regard.

Figure 5:
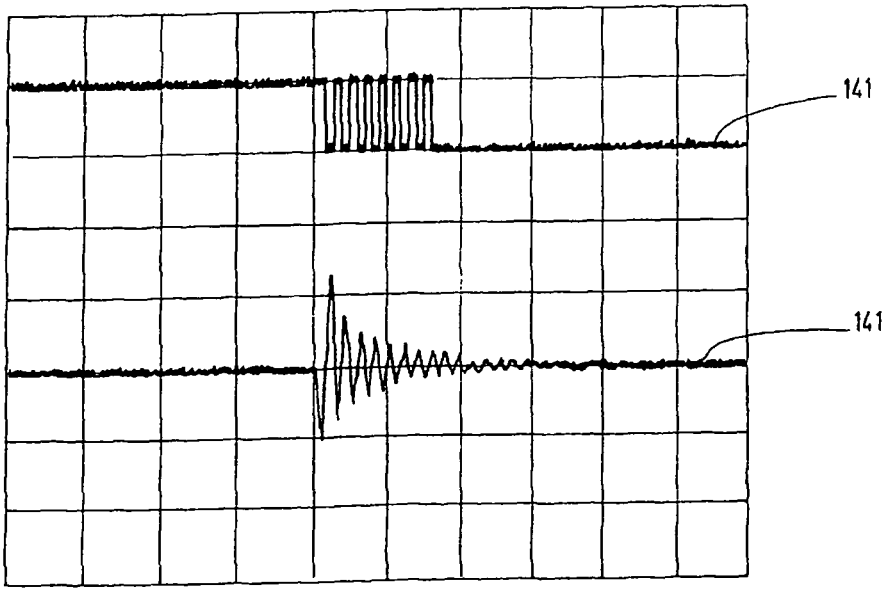
FIG. 5 is a graph of measurement results of the acoustic measuring method in the form of a curve of two characteristic variables of oscillation, such as those obtained in measurement operation using the apparatus according to FIG. 4.

As FIG. 5 shows, an oscillation characteristic variable 141 or multiple oscillation characteristic variables can be detected here by the measuring apparatus 115. FIG. 5 shows two sets of curves, where the top curve shows a number of oscillations of the metal tongues 134, 135 above a predefinable threshold value of an oscillation amplitude in the direction of consideration of FIG. 5. The bottom curve in the angle of view in FIG. 5, however, shows an example of plotting the absolute oscillation amplitude of the metal tongues 134, 135 as a function of time.

Depending on which medium comes in contact with the sensor element 117, the oscillation curves according to the exemplary diagram in FIG. 5, pertaining to a WD-40 spray oil, look different. Thus the curves for air, nitrogen gas, water, various hydraulic oils and lubricating oils, cold cleaning agents such as alcohol or the like, including fuels such as diesel oil, differ substantially from one another. With this sensor element 117, the overflow of fluid to the gas side of the hydraulic accumulator 3 can be detected.

As FIG. 4 also shows, the sensor element 117 has a sleeve 143, which is preferably formed from a mineral glass material. The sleeve 143 completely encloses the metal tongues 134, 135 both radially and axially, while maintaining a minimum radial distance from the metal tongues 134, 135, so as not to have a negative effect on their excited oscillation. The sleeve 143 in this regard has two openings 145 for the media access to the respective metal tongues 134, 135.

The energy for operation of the sensor element 117 and the measuring apparatus 115 is supplied from the outside by an electric energy source 147 in the form of a battery (not shown) or preferably in a hard-wired operation in which the sensor 117 is in turn connected by a cable connection 123 in the form of the connection 19 to the electronic analyzer 133.

In addition to the measuring method described here, optical methods may also be used. Scattered light methods are very suitable for detection of fluid mists if such a mist is to be formed on the gas side of the accumulator bladder 37. With certain media, the presence of luminescence might also be used for detection. Other optical analytical options may be seen in the reflection or attenuation properties of various liquids with respect to the passage of light through a sensor. Optical waveguides, i.e., fiber-optic cables, are preferably used when using optical measuring methods.

Furthermore, electric measuring methods, preferably based on the measurement of dielectric or conductive properties of the medium in the sense presented here, may be used. Fluids and gases can also be differentiated from one another on the basis of the dielectric constant as well as the conductivity.

Measurement systems, in which an element changes because of a chemical or physical reaction on coming in contact with the liquid to be detected, are to be used with chemical measuring methods. These changes may include the following in the case of the inadvertent transfer of media as described here:

Swelling or increase in volume of a sensor element;

Dissolving or reduction in volume of a sensor element;

Change in color of a sensor element and

Change in electric properties of a sensor element.

The separation or dissolution of the sensor element can be detected, for example, with a spring bias switch. This switch is preferably designed so that the change in volume opens or closes the switch and delivers a signal to the electronic measuring apparatus 33. Plastics are preferred as the materials for the sensor elements mentioned here. Depending on the liquid to be detected, an unstable plastic that responds to this liquid is preferably selected.

If a polymer as a sensor element changes its color based on its contact with the fluid, this color change can in turn be detected by suitable measuring methods. If the polymer is embodied preferably as an absorbent nonwoven, the nonwoven can transport the fluid to the sensor element, thereby forming a spatially distributed sensor and analysis system.

If the electric conductivity changes on contact with the fluid, this effect can also be used for detection. As with the electric method already mentioned, a thin film interdigital electrode structure coated with the polymer may be used, for example.

In conclusion, reference should also be made to measuring methods including mechanical oscillators. The measurement principle in this regard is based on the viscosity difference between the working gas and the fluid. The viscosity of nitrogen thus depends on both the pressure and temperature, but on the whole it is more than two orders of magnitude below the viscosity of hydraulic fluids in the entire range that is relevant for measurement application.

The mechanical oscillator (not shown) is situated within the fluid and its oscillation is attenuated accordingly by the fluid. The attenuation acting on the oscillator is proportional to the viscosity of the fluid.

The following mechanical oscillators may be considered in particular:

Oscillating quartz crystals such as a quartz crystal microbalance (QCM),

Surface acoustic wave sensors (SAW),

Micromechanical tuning forks,

Magnetoelastic films,

Mechanical-magnetic systems based on coils and soft magnetic oscillating elements.

QCM sensors, SAW sensors and micromechanical tuning forks can be used very well for determining the viscosity of hydraulic fluids. The measurement technique in this regard is very suitable to detect unintentional overflow of media in hydraulic accumulators.

Furthermore, magnetoelastic films may be used in which the resonance frequency of a magnetoelastic film changes with the ambient conditions, i.e., with the medium in which the film is situated. The film is preferably excited to resonance by a magnetic coil. The oscillation of the magnetoelastic film can be detected by a separate pickup coil or by the exciter coil itself. This effect can also be used for differentiation as to whether the sensor film is in oil or gas. The mechanical oscillators in this regard can be assigned to the physical measuring methods in the sense of the present subject matter of the patent application.

While various embodiments have been chosen to illustrate the invention, it will be understood by those skilled in the art that various changes and modifications can be made therein without departing from the scope of the invention as defined in the claims.

The invention claimed is:

1. A media separating device, comprising a housing having first and second chambers with first and second flowable media therein, respectively;

a movable separator in said housing separating said first and second chambers; and a measuring apparatus in said first chamber detecting an overflow of said second medium through said movable separator and into said first chamber, said measuring apparatus including at least one sensor element, said sensor element having a connection to a fixed location with respect to said first chamber and contacting the overflow of said second medium in each position assumed by said movable separator.

2. A media separating device according to claim 1 wherein said sensor element is at least one of a thermal measuring sensor, a chemical measuring sensor, a physical measuring sensor, and optical measuring sensor, an acoustic measuring sensor or an electrical measuring sensor.

3. A media separating device according to claim 2 wherein said sensor element is a thermal measuring sensor measuring thermal conductivity.

4. A media separating device according to claim 2 wherein said sensor element is an optical sensor measuring at least one of properties of mist formation, illuminescence or reflection.

5. A media separating device according to claim 2 wherein said sensor element is a chemical measuring sensor involving at least one of color or shape changes.

6. A media separating device according to claim 2 wherein said sensor element is a physical measuring sensor measuring behavior responding to mechanical oscillators.

7. A media separating device according to claim 2 wherein said sensor element is an acoustic measuring sensor measuring acoustic attenuation properties.

8. A media separating device according to claim 2 wherein said sensor element is an electrical sensor measuring electrical conductivity properties.

9. A media separating device according to claim 1 wherein said connection comprises at least one flexible cable having first and second ends that are opposite one another, said first end being connected to said sensor element, said second end being connected to the fixed location on a part of said housing bordering said first chamber.

10. A media separating device according to claim 1 wherein said second end of said cable is connected to a plug part.

11. A media separating device according to claim 1 wherein said plug part comprises an electronic analyzer.

12. A media separating device according to claim 1 wherein said housing and said separator comprise a hydraulic accumulator.

13. A media separating device according to claim 12 wherein said hydraulic accumulator is a bladder accumulation in which said separator is a flexible bladder;

said first chamber is a gas side of said hydraulic accumulator, with said first medium being a gas; and said second chamber is a fluid side of said hydraulic accumulator, with said second medium being a fluid.

14. A conversion kit for a media separating device, where the media separating device includes a housing having first and second chambers with first and second flowable media therein, respectively, and includes a movable separator in the housing separating the first and second chambers, the conversion kit comprising:

a sensor element locatable in said first chamber and able to detect an overflow of the second medium through the separator and into the first chamber;

at least one flexible cable having a connection at a first end of the cable connectable to a fixed part of the housing and having a second end connectable to the sensor element to locate the sensor element in the first chamber to contact the overflow of the second medium in each position assumed by the movable separator; and at least one electronic analyzer.

15. A conversion kit according to claim 14 further comprises a replacement movable separator.

16. A measuring method for operating a measuring apparatus in a media separating device, where the media separating device includes a housing having first and second chambers with first and second flowable media therein, respectively, and includes a movable separator in the housing separating the first and second chambers, the method comprising the steps of:

locating a sensor element in said first chamber to contact an inadvertent overflow of the second medium through the separator and into the first chamber; and detecting the overflow by measuring differences in the first and second media of at least one of thermal conductivity, optical properties of mist formulation or illuminescence or reflection, acoustic attenuation properties, electrical conductivity properties, chemical properties involving shape or color change, or physical properties in behavior responding to mechanical oscillators.

17. A measuring method according to claim 16 wherein the measuring of the differences in the first and second media is by the thermal conductivity, the optical properties, the acoustic attenuation properties, the electrical conductivity, the chemical properties and the physical properties.

18. A measuring method according to claim 16 wherein the measuring of the differences in the first and second media is by the thermal conductivity.

19. A measuring method according to claim 16 wherein the measuring of the differences in the first and second media is by the optical properties.

20. A measuring method according to claim 16 wherein the measuring of the differences in the first and second media is by the electrical conductivity.

21. A measuring method according to claim 16 wherein the measuring of the differences in the first and second media is by the chemical properties.

22. A measuring method according to claim 16 wherein the measuring of the differences in the first and second media is by the physical properties.

23. A measuring method according to claim 16 wherein the measuring of the differences in the first and second media is by the acoustic attenuation properties.

* * * * *